US005503899A

United States Patent [19]

Ashida et al.

[11] Patent Number: 5,503,899

[45] Date of Patent: Apr. 2, 1996

[54] SUEDE-LIKE ARTIFICIAL LEATHER

[75] Inventors: Tetsuya Ashida; Hisao Yoneda, both of Okayama; Tuyosi Yamasaki, Kurashiki, all of Japan

[73] Assignee: Kuraray Co., Ltd., Okayama, Japan

[21] Appl. No.: 331,954

[22] Filed: Oct. 31, 1994

[30] Foreign Application Priority Data

Oct. 29, 1993 [JP] Japan ..... 5-271789

[51] Int. Cl.[6] ..... B32B 9/00

[52] U.S. Cl. ..... 428/151; 428/96; 428/156; 428/171; 428/172; 428/233; 428/239; 428/252; 428/298; 428/303; 428/903; 428/904

[58] Field of Search ..... 428/96, 233, 239, 428/151, 156, 160, 171, 172, 175, 252, 284, 287, 298, 303, 903, 904, 286, 224

[56] References Cited

U.S. PATENT DOCUMENTS

| | | | |
|---|---|---|---|
| 3,705,226 | 12/1972 | Okamoto et al. | 264/162 |
| 4,620,852 | 11/1986 | Nishikawa et al. | 8/515 |

FOREIGN PATENT DOCUMENTS

| | | |
|---|---|---|
| 0098603 | 1/1984 | European Pat. Off. . |
| 0165345 | 12/1985 | European Pat. Off. . |
| 617159 | 9/1994 | European Pat. Off. . |
| 0617159 | 9/1994 | European Pat. Off. . |
| 2034195 | 2/1971 | Germany . |
| 55-506 | 1/1980 | Japan . |
| 57-154468 | 9/1982 | Japan . |
| 61-25834 | 1/1986 | Japan . |
| 61-46592 | 10/1986 | Japan . |
| 63-243314 | 10/1988 | Japan . |
| 3-260150 | 11/1991 | Japan . |
| 5-156579 | 6/1993 | Japan . |

*Primary Examiner*—Patrick J. Ryan
*Assistant Examiner*—Abraham Bahta
*Attorney, Agent, or Firm*—Wenderoth, Lind & Ponack

[57] ABSTRACT

A suede-like artificial leather which is composed of fiber bundles and an elastomeric polymer, has fibrous nap on its surface and is dyed, said fiber bundles being composed of fine fibers (A) having a finess of 0.02–0.2 denier and microfine fibers (B) having a fineness not more than ⅕ of the average fineness of said fine fibers (A) and also less than 0.02 denier, said fibers (A) and (B) being substantially uniformly dispersed in cross sections of the fiber bundles, the ratio between the strand numbers of fibers (A) to fibers (B) ranging from ½ to ⅔, said fiber bundles not substantially containing the elastomeric polymer in the interspaces among the individual fibers constituting each of the fiber bundles, and the ratio of the number of fibers (A) to that of fibers (B) in the nap-constituting fibers being at least 3/1, is provided. The artificial leather has good appearance and hand and excels in color-developing property and pilling resistance, and is useful for making cloths, shoes, pouches, gloves and the like.

5 Claims, 1 Drawing Sheet

SUEDE-LIKE ARTIFICIAL LEATHER

Figure 1:
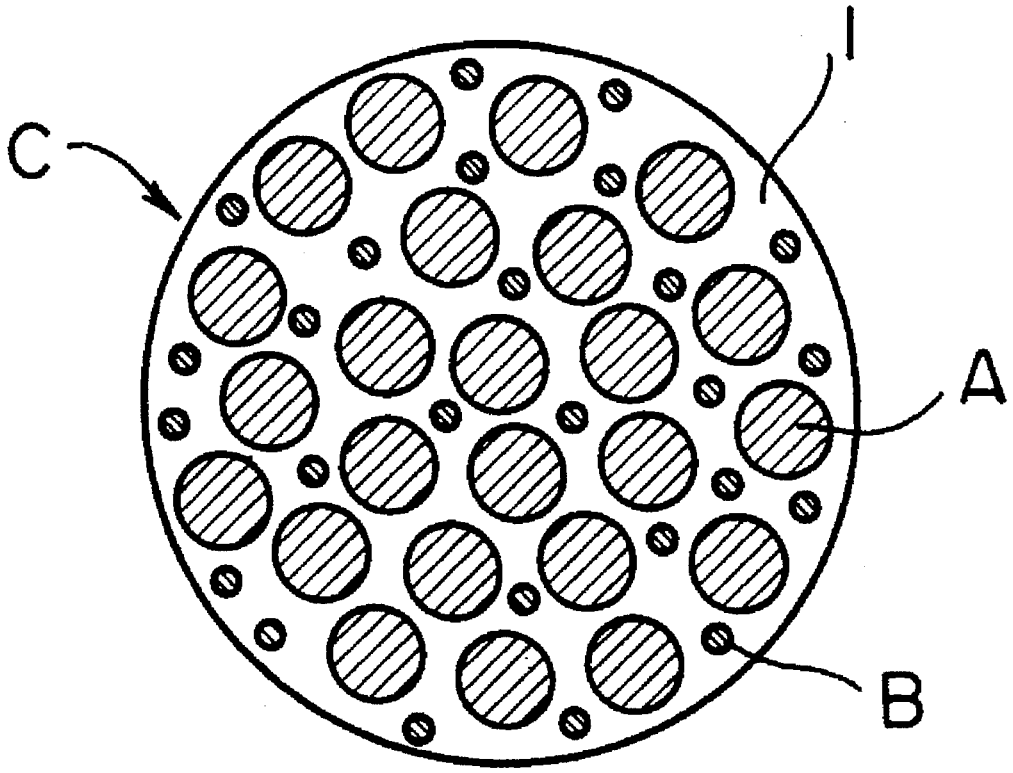

This invention relates to a suede-like artificial leather which has good appearance and feeling, and also excels in color-developing property and pilling resistance, and a production process thereof.

Suede-like artificial leather, having a nap composed of fiber bundles which is formed on a surface of a substrate composed of the same fiber bundles and an elastomeric polymer, is known. Whereas, in the field of suede-like artificial leather, recently a high quality product is in demand, which satisfies all of such sensory requirements as the appearance (suede-like appearance), hand (soft touch) and color-developing property as well as physical requirement, e.g., pilling resistance.

More specifically, it is generally practiced to reduce the size of artificial leather-constituting fibers to microfine denier level, for the purpose of obtaining suede-like artificial leather of excellent appearance, but a leather containing such microfine denier fibers cannot be dyed to clear colors, but to only dull, whitish colors, being inferior in color developing property. It has also been practiced to substantially eliminate the elastomeric polymer from the interspaces among the individual fibers constituting each of the fiber bundles which constitute an artificial leather in order to render the hand of the leather extremely soft, pleasant one. When no elastomeric polymer is present in said interspaces (hereafter simply referred to as inside of the fiber bundles), however, the raised fibers are readily pulled out to aggravate the property which is normally referred to as pilling resistance.

Concerning improvement of color-developing property of suede-like artificial leather with a fibrous nap, various proposals have been made in the past. For example, Japanese Patent Publication S55-506 proposed to apply an easy dyeable resin onto surfaces of a sheet with fibrous nap and to dye the sheet, and Japanese Patent Publications S61-25834 or S61-46592 proposed a method of dyeing artificial leather with a dyestuff which becomes water-soluble as reduced in the presence of an alkali, and then oxidizing the dye to fix it on the leather.

For improving pilling resistance of suede-like artificial leather with fibrous nap, Japanese Kokai (laid-open) Publication S57-154468A has proposed a method of dissolving a part of the polymer used in the leather with a solvent for the polymer, to fix the roots of the fibers forming the nap on the surface.

As microfine denier fiber bundles in which microfine fibers of differing deniers are mixed, Japanese Kokai (laid-open) Publication S63-243314A has disclosed a fibrous structure of blended yarn wherein the size distribution of island component satisfies the relationship of DC≧1.5DS, DS denoting the denier of the island component present within ¼ of the radius from the outer periphery and DC denoting the denier of the island component present within ⅔ of the radius from the center point. Also a fibrous sheet whose microfine denier fiber bundles contain polyurethane within the bundles and ultrafine polyolefin fibers having an average diameter no greater than 1.0 μm and an aspect ratio of 500–2200 are dispersed in the inside and around said bundles has been disclosed by Japanese Kokai H3-260150A. Japanese Kokai H5-156579A has disclosed a polyamide microfine denier fiber-forming fibers in which 0.02–0.2 denier fine fibers (A) and 0.001–0.01 denier microfine fibers (B) are dispersed as an island component, the weight ratio of (A)/(B) being 30/70 to 70/30; and suede-like artificial leather prepared from said fibers.

Such methods for improving color-developing property as described in above Publications S55-506, S61-25834 and S61-46592 could improve the developing property per se, but degrade appearance and hand of the fibrous nap side of the product. Whereas, by the technology described in Kokai S63-243314, it is difficult to concurrently maintain good appearance and developing property, because in its product microfine denier fibers of different sizes are each localized and the technology is incapable of increasing the denier difference among the microfine fibers serving as the island components.

The technology described in Kokai H5-156579 achieves a minor improvement in developing property over the technology of Kokai S63-243314. However, due to high microfine denier fibers (B) content in the product a large number of microfine denier fibers are present on the napped surface and color-developing property of the product is yet insufficient. While it is possible to increase the product's developing property by selectively cutting and eliminating the microfine denier fibers on the napped surface under the severe conditions normally employed for napping the surfaces, the operation under such severe conditions injures and cuts also the fine fibers (A), resulting in failure to obtain suede-like artificial leather of favorable appearance.

Furthermore, by the method described in Kokai S57-154468, it cannot be avoided that the product has harder hand, because of the polyurethane present in inside the microfine denier fiber bundles.

The object of the present invention, therefore, is to provide a suede-like artificial leather having good appearance and hand and also excelling in color developing property and pilling resistance, and a process for making such a leather.

According to the present invention, as a product accomplishing the above object, provided is a suede-like artificial leather in which fibrous nap is present on a surface of a substrate composed of fiber bundles and an elastomeric polymer, and which has been dyed, the fiber bundles which form said substrate being composed of fine fibers (A) having a fineness of 0.02–0.2 denier and microfine fibers (B) having a fineness not more than ⅕ of the average fineness of said fine fibers (A), which fineness also being less than 0.02 denier, the ratio of number of A to B ranging 2/1–2/3; said fiber bundles not substantially containing an elastomeric polymer in their inside; and when the napped surface is observed from above, the ratio of the number of A to number of B in the napped fiber bundles being at least 3/1.

The suede-like artificial leather of the present invention can be obtained by, for example, carrying out the following steps (a)–(f) by the order stated.

(a) a step for making fine fiber- and microfine fiber-forming fiber (C) which are composed of a sea component polymer removable by dissolution or decomposition and island components comprising fine fibers (A) having a size ranging 0.02–0.2 denier and microfine fibers (B) having a size no more than ⅕ of the average denier of said fibers (A) and less than 0.02 denier, said island components being present as dispersed in cross-sections of said fibers (C), and said fibers (C) being convertible into fiber bundles containing said fine fibers (A) and microfine fibers (B) at a strand number ratio of A/B=2/1 to 2/3, (b) a step for making an entangled non-woven fabric composed of said fibers (C), (c) a step for impregnating the non-woven fabric with an elastomeric polymer liquid and wet coagulating the same to form a substrate (d) a step for converting said fibers (C) into fiber bundles composed of said fine fibers (A) and microfine fibers (B), (e) a step for forming a nap on at least one surface of said substrate, and (f) a step for dyeing the resulting napped nonwoven fabric.

Examples of the polymers which constitute the island component in the microfine fiber-forming fibers (C) of the present invention, that is, the polymers for forming the fine fibers (A) and microfine fibers (B), include melt-spinnable polyamides such as 6-nylon, 66-nylon, etc. and melt-spinnable polyesters such as polyethylene terephthalate, polybutylene terephthalate, cation-dyeable modified polyethylene terephthalate, etc. The fine fibers (A) and microfine fibers (B) may be made of either a same polymer or different polymers.

Whereas, the polymer constituting the sea component has a different solubility or decomposability in solvents or decomposing agents from those of the island component (the sea component-forming polymer has the greater solubility or decomposability), has a low affinity with the island component, and exhibits a lower melt viscosity or less surface tension than those of the island component under spinning conditions. Examples of such polymers include easy-soluble polymers such as polyethylene, polystyrene, modified polystyrene, ethylene/propylene copolymers, etc. and easy-decomposable polymers such as polyethylene terephthalate which has been modified with sodium sulfoisophthalate, polyethylene glycol or the like.

The attached drawing shows a type of cross-section of a microfine fiber-forming fibers (C).

As illustrated in the drawing, the microfine fiber-forming fiber (C) contains in its sea component (1) two groups of fibers as the island component, i.e., fine fibers (A) of the greater average denier and microfine fibers (B) of the less average denier, said fine fibers (A) and microfine fibers (B) being approximately uniformly dispersed over the whole cross-sectional area of said fiber (C). That is, such fibers wherein fine fibers (A) and microfine fibers (B) are unevenly distributed are unfit for use in the present invention. The fine fibers (A) and microfine fibers (B) differ not only in average denier, but also in denier size of individual fibers constituting the respective groups to such an extent as allowing clear distinction.

Such a microfine fiber-forming fiber (C) can be obtained by a method comprising melting a mixture of a microfine fibers (B)-forming polymer and a sea component polymer at a predetermined blend ratio, feeding the melt into a spinning machine concurrently with a melt of a fine fiber (A)-forming polymer which has been melted in a different melting system from the first, repeating joining and dividing of the melts at the spinning head several times to form a mixed system of the two and spinning the same; or by a method in which the two melts are combined and the fiber shape is defined at the spinneret portion, and then spun. That is, the fibers (C) are obtained by mixing the fiber (B)-forming polymer and the sea component polymer at a predetermined ratio and melting the mixture in a same melting system, and bi-component spinning the melt with another melt of fiber (A)-forming polymer in such a manner that the latter is approximately uniformly dispersed in the former.

As previously stated, fine fibers (A) and microfine polymers (B) may be formed from a same polymer or from different polymers. However, the denier size of fine fibers (A) must range 0.02–0.2, while that of microfine fibers (B) must be no more than ⅕ of average denier size of fibers (A) and less than 0.02 denier. Furthermore, the ratio between the number of fibers (A) and that of fibers (B) must be within a range of 2/1 to 2/3.

When the size of fine fibers (A) is less than 0.02 denier, the product exhibits insufficient color-developing property, while when it is greater than 0.2 denier, it becomes difficult to secure the high quality of appearance. Furthermore, it is preferred for fine fibers (A) to have an approximately uniform denier size, for achieving favorable appearance and hand. More specifically, it is preferred that the denier size ratio of the finest fiber (A) and the thickest fiber (A) within a fiber bundle is within a range of 1:1–1:3.

The microfine fibers (B) are to entangle onto the fine fibers (A) to prevent pilling. In order to simultaneously accomplish retention of high quality appearance and securing of good developing property, the fibers (B) need to have a denier size not more than ⅕ of average denier size of fine fibers (A) and less than 0.02 denier; preferably between 1/10 and 1/50 of average denier size of fine fibers (A) and between 0.01 and 0.001 denier; still more preferably between 0.01 denier and 0.0015 denier. When the denier size of the microfine fibers (B) is too low, only poor pilling preventing effect is obtained. Thus, the preferred lower limit is 0.001 denier, more preferably 0.0015 denier. Because the microfine fibers (B) are formed by the method of melting the starting polymer in the same melting system with the sea component polymer as aforesaid, generally denier size variation among individual fibers is large. In the present invention, however, those fibers having the denier size not more than ⅕ of average denier size of fine fibers (A) and less than 0.02 denier are called the microfine fibers (B).

The length of the microfine fibers (B) is limited because they are obtained from a stream of molten mixed polymer, but preferably they should have a length of 5 mm or more, to achieve satisfactory pilling prevention. The length is controllable by selecting the combination of polymers in the occasion of spinning. When aforesaid polyester or polyamide polymers are used as the constituent, microfine fibers (B) of sufficiently great length can be obtained.

According to the present invention, the fiber bundles preferably consist substantially of above-described fine fibers (A) and microfine fibers (B) only, but presence of a minor amount of fibers not belonging to the scope of either (A) or (B) is permissible. It is preferred for favorable developing property as well as appearance that the number of fine fibers (A) present in a cross-section of single fiber bundle is within a range of 15–100.

According to the present invention, both fine fibers (A) and microfine fibers (B) are mixedly present in the nap-forming fiber bundles before buffing. In the buffing step for forming nap, microfine fibers (B) are more easily broken. Consequently, the ratio between the strand numbers of fine fibers (A) and microfine fibers (B) at the outermost surface of the nap becomes greater than that in the substrate layer. Developing property of the product is affected by the fineness of the fibers present at the outermost surface part of the nap. Thus, the higher the ratio of fine fibers (A) present in said part, the better developing property can be obtained. It is necessary to obtain good developing property that the A/B ratio is at least 3/1. It is possible to reduce the number of microfine fibers (B) present in the outermost napped surface to substantially zero, by suitably selecting the napping treating conditions, and in that case the A/B ratio becomes infinite. Under ordinary industrial napping treating conditions, the A/B ratio is not greater than 100/1.

When the A/B ratio in the substrate layer is 2/1 or greater, the A/B ratio in the outermost napped surface becomes also high, which is preferred from the standpoint of developing property. Whereas, in such a case the pilling-preventing effect achieved by entanglement of microfine fibers (B) onto fine fibers (A) is drastically reduced, and the product will exhibit inferior pilling resistance. When the A/B ratio in the substrate layer is ⅔ or less, on the other hand, buffing must be slowly and repeatedly conducted in order to increase the A/B ratio at the napped surface to at least 3/1. This invites reduction in productivity. When the buffing is conducted under severe conditions to increase the productivity, not only the microfine fibers (B) but also the fine fibers (A) come to be broken, and a high quality suede-like product cannot be obtained. Thus, it is very important that the ratio between the strand numbers of fine fiber (A) and microfine fiber (B) (A/B) in the substrate should be within the range of 2/1 to 2/3, in order to simultaneously achieve retention of high grade appearance and improvement in developing property and pilling resistance.

Denier size, strand number and length of microfine fibers (B) can be controlled by changing combination of such factors as the blend ratio of a polymer composing microfine fibers (B) and a sea component polymer, melt viscosity and surface tension. In general terms, a higher ratio of microfine fibers (B)-forming polymer results in a greater number of strands of the fibers (B), while their denier size remains about the same; and higher melt viscosity and surface tension tend to increase the denier size, decrease the strand number and shorten the fiber length. Based on those known tendencies, the denier size, strand number and fiber length of microfine fibers (B) in a fiber (C) can be predicted by test spinning at individual spinning temperature and spinning speed to be employed, as to any suitable combination of a microfine fiber-composing polymer and a sea component polymer.

The ratio of the sum of a fine fiber (A) component and microfine fiber (B) component in a microfine fiber-forming fiber (C) is preferably within a range of 40–80% by weight, viewed from spinning stability and economy.

Microfine fiber-forming fibers (C) are processed to fibers of 2–10 deniers in size, if necessary through such steps as drawing, crimping, thermal setting and cutting. The terms, denier size and average denier size, as used herein can be readily determined from cross-sections of pertinent microfine fiber-forming fibers (C), i.e., by taking micrographs of the cross-sections, counting the numbers of the fine fibers (A) and microfine fibers (B), respectively, and dividing the respective weights of the fine fibers (A) and microfine fibers (B) in the 9000 m-long fiber (C) containing them by the numbers of the respective fibers. By a similar method denier sizes and average denier sizes of the fibers (A) and (B) can be readily determined from the fiber bundles composed of said fibers (A) and (B), after fibers (C) are converted into such fiber bundles. Concerning fiber length of microfine fibers (B), furthermore, it can be readily determined whether or not it is at least 5 mm, by treating the eventually produced suede-like artificial leather with dimethylformamide or the like to remove the elastomeric polymer therefrom, and observing the remaining fiber bundles with a microscope.

Microfine fiber-forming fibers (C) are opened with a card, passed through a webber to form random webs or cross-lap webs, and the resulting webs are laminated to an optional weight and thickness. The laminated webs are then subjected to a known entangling treatment such as needle punching, water-jet entanglement or the like, to be converted to a fiber-entangled non-woven fabric. If necessary, fiber other than the microfine fiber-forming fibers (C) may be added in a minor amount in the occasion of forming said non-woven fabric. Again if desired, a resin which can be dissolved away, for example, a polyvinyl alcohol-derived resin, may be applied to the non-woven fabric to provisionally set the same.

Then the non-woven fabric is impregnated with an elastomeric polymer and coagulated. The elastomeric polymer useful for this operation is, for example, a polyurethane obtained by reacting at least one polymer diol having an average molecular weight of 500–3,000 selected from the group comprising polyester diols, polyether diols, polyetherester diols, polycarbonate diols, etc: at least one diisocyanate selected from aromatic, alicyclic and aliphatic diisocyanates such as 4,4'-diphenylmethane diisocyanate, isophorone diisocyanate, hexamethylene diisocyanate, etc.; and at least one low molecular weight compound having at least two active hydrogen atoms, such as ethylene glycol, ethylenediamine, etc.; at prescribed mol ratios. Such a polyurethane can be used as a polyurethane composition, if necessary, by adding thereto such a polymer as synthesized rubber, polyester elastomer, or the like.

So formed polyurethane or a polyurethane composition is dispersed in a solvent or a dispersing agent, and the resulting polymer liquid is impregnated in the non-woven fabric. By treating the system then with a non-solvent of the polymer to effect wet coagulation, intended fibrous substrate is obtained. If required, such an additive or additives as a coloring agent, coagulation regulator, antioxidant, etc., may be blended into the polymer liquid. The amount of the polyurethane or polyurethane composition in the fibrous substrate is, as solid, preferably within a range of 10–50% by weight.

The fibrous substrate is subsequently treated with a liquid which is a non-solvent of the microfine fiber component (B), fine fiber component (A) and the elastomeric polymer and is a solvent or a decomposing agent of the sea component in the fibers (C). As the liquid, toluene is used, for example, when said components (A) and (B) are nylon or polyethylene terephthalate and the sea component is polyethylene: and an aqueous caustic soda solution is used when said components (A) and (B) are nylon or polyethylene terephthalate and the sea component is an easy alkali-decomposable polyester. With this treatment the sea component polymer is removed from the microfine fiber-forming fibers (C), leaving fiber bundles composed of the microfine fibers (B) and fine fibers (A). Thus converted fiber bundles do not substantially contain the elastomeric polymer in their inside. When the non-woven fabric is provisionally set with a soluble and removable resin, the resin should necessarily be dissolved and removed before or after the above treating step.

The substrate is then sliced into plural sheets in the thickness direction, if necessary, and at least one of the surfaces of each sheet is given a napping treatment to form a napped surface composed chiefly of the fine and microfine fibers. For forming the napping surface, any known method such as buffing with a sand paper may be employed.

Thus obtained suede-like fibrous substrate is then dyed. The dyeing is carried out according to normal dyeing methods, using such dyestuffs composed mainly of acidic dyes, premetallyzed dyes, dispersed dyes, etc., depending on the kind of fibers present in the substrate. Dyed suede-like fibrous substrate is given a finish treatment or treatments such as rubbing, softening, brushing, etc. to provide suede-like artificial leather.

The suede-like artificial leather of the present invention has good appearance and hand and excels in developing property and pilling resistance. It is useful as materials for clothing, shoes, pouches, gloves and the like.

Hereinafter typical embodiments of the present invention are explained referring to specific working examples, it being understood that the invention is in no sense limited to these examples. In the examples, parts and percentages are by weight, unless specified otherwise.

EXAMPLE 1

A melt formed by melting 5 parts of 6-nylon [microfine fiber (B) component] and 35 parts of polyethylene in a same melting system, and another melt of 60 parts of 6 nylon [fine fiber (A) component], which was molten in a different melting system, were spun into microfine fiber-forming fibers (C) having a size of 10 deniers, by a method of defining the fiber shape at the spinneret portion. The spinning conditions were so controlled that the number of fine fibers (A) present in the fiber (C) was 50. When cross-sections of said fibers (C) were observed, the average number of microfine fibers (B) per a strand of fiber (C) was found to be about 50, and the fibers (A) and (B) were substantially uniformly dispersed.

Thus obtained fibers (C) were stretched by 3.0X, crimped, cut to a fiber length of 51 mm, opened with a card and formed into webs with a cross-lap webber. The webs were converted to a fiber-entangled non-woven fabric having a density of 650 g/m$^2$ by needle punching. During these steps the fibers showed autogeneous shrinkage and their size was reduced to about 4.5 deniers. The non-woven fabric was impregnated with a solution composed of 13 parts of a polyurethane composition whose chief component was a polyether-derived polyurethane and 87 parts of dimethylformamide (DMF), followed by coagulation and aqueous washing. Then the polyethylene in the fibers (C) was removed by extraction with toluene, to provide an about 1.3 mm-thick fibrous substrate consisting of 6-nylon fine and microfine fiber bundles and polyurethane.

When cross-sections of these fiber bundles in the fibrous substrate were observed with an electron microscope, the average size of the fine fibers (A) was 0.054 denier, with substantially no denier variation; and the microfine fibers (B) invariably had a size ranging between 0.01 denier and 0.001 denier, the average size being 0.0045 denier. Also the most part of the microfine fibers (B) had a length of at least 5 mm.

One of the surfaces of this substrate was buffed to be adjusted of its thickness to 1.20 mm, and thereafter the other surface was treated with an emery raising machine to form a napped surface in which the fine and microfine fibers were raised. The substrate was then dyed with Irgalan Red 2GL (Chiba Geigy) at a concentration of 4% owf. After subsequent finish treatments, the napped surface of the resultant suede-like artificial leather was enlarged by 500X with an electron microscope. When the so taken electron micrograph was observed, the ratio between the numbers of A to B was 8/1. The product exhibited excellent developing property, and very good appearance and hand.

Comparative Example 1

Thirty-five (35) parts of polyethylene and 65 parts of 6-nylon were separately melted in different systems, and together spun by a method of spinning while defining the fiber shape at the spinnert portion, in such a manner that the number of island component (6-nylon) fibers was 50. Except that thus obtained microfine fiber-forming fibers of 10 deniers in size were used, the procedures of Example 1 were repeated to provide a dyed suede-like artificial leather.

An electron microscopic observation of cross-sections of the fiber bundles constituting the substrate of this suede-like artificial leather revealed that the average denier of 6-nylon fibers corresponding to fine fibers (A) was 0.063, and that substantially no fiber corresponding to the microfine fibers (B) was present.

The resulting product exhibited good developing property but inferior pilling resistance.

Comparative Example 2

A 10 denier size microfine fiber-forming fibers were obtained by a method of spinning while defining the fiber shape at the spinneret portion, by feeding to the spinning machine 15 parts of 6-nylon [microfine fiber (B) component] and 50 parts of polyethylene which were molten in a same melting system, and 35 parts of 6-nylon [fine fiber (A) component] which was molten in a separate system, in such a manner that the number of fine fibers (A) became 50. Except that so obtained microfine fiber-forming fibers were used, the procedures of Example 1 were repeated to provide a dyed suede-like artificial leather.

An electron microscopic observation of cross-sections of the fiber bundles constituting the substrate of this suede-like artificial leather revealed that the average size of the fine fibers (A) was 0.034 denier with substantially no variation in the denier size. Microfine fibers (B) invariably had a denier within the range of 0.007–0.001, the average denier being 0.004. Also when cross-sections of microfine fiber-forming fibers were observed with an electron microscope, the number of the microfine fibers (B) was about 180. A 500X enlarged electron micrograph of the napped surface of the resultant suede-like artificial leather revealed that the ratio in numbers of A to B was 2.2/1. The product exhibited drastically inferior developing property, while its pilling resistance was satisfactory.

EXAMPLE 2

A melt formed by melting 5 parts of polyethylene terephthalate [microfine fiber (B) component] and 30 parts of polyethylene in a same melting system, and 65 parts of polyethylene terephthalate [fine fiber (A) component], which was molten in a different melting system, were spun into microfine fiber-forming fibers (C) having a size of 10 deniers, by a method of defining the fiber shape at the spinneret portion. The spinning conditions were so controlled that the number of fine fibers (A) present in the fiber (C) was 50. When cross-sections of said fibers (C) were observed in that occasion, the average number of microfine fibers (B) per a strand of fiber (C) was found to be about 50, and the fibers (A) and (B) were substantially uniformly dispersed.

Thus obtained fibers (C) were stretched by 3.0X, crimped, cut into 51 mm-long fibers, opened with a card, and converted into webs with a cross-lap webber. The webs were subjected to a needle punching treatment, caused to shrink by 40% in area in hot water, and formed into a fiber-entangled non-woven fabric having a density of 820 g/m$^2$. The non-woven fabric was impregnated with a solution composed of 13 parts of a polyurethane composition whose chief component was a polyether-derived polyurethane and 87 parts of DMF, followed by coagulation and aqueous washing. Then the polyethylene in the fibers (C) was removed by extraction with toluene, to provide a 1.3 mm-thick fibrous substrate consisting of polyethylene terephthalate fine and microfine fiber bundles and polyurethane.

When cross-sections of the fiber bundles in the fibrous substrate were observed with an electron microscope, the average denier of fine fibers (A) was 0.060 denier, with substantially no denier variation; and the microfine fibers (B) invariably had a size ranging between 0.01 and 0.0015 denier, the average size being 0.005 denier. No polyurethane was contained inside the fine and microfine fiber bundles. Also the length of the microfine fibers (B) was predominantly no less than 5 mm.

One of the surfaces of this substrate was buffed to be adjusted of its thickness to 1.20 mm, and then the other surface was treated with an emery raising machine to form a napped surface in which the fine and microfine fibers were raised. The substrate was dyed with Resolin Blue 2BRS at a concentration of 2% OWf. The dye deposited on the polyurethane was reduction cleared and the product was finished. The napped surface of the resulting suede-like artificial leather was enlarged by 500X with an electron microscope. When the so taken electron micrograph was observed, the ratio between the numbers of A to B was 8/1. The product exhibited excellent developing property and very good appearance as well as hand.

Comparative Example 3

A 10 denier size microfine fiber-forming fibers were obtained by a method of spinning while defining the fiber shape at the spinneret portion, by feeding to the spinning machine 5 parts of polypropylene [microfine fiber (B) component] and 35 parts of polyurethane which were molten in a same melting system, and 60 parts of 6-nylon [fine fiber (A) component] which was molten in a separate system, in such a manner that the number of fine fibers (A) present in the microfine fiber-forming fiber was 50. When cross sections of the fibers were observed in that occasion, the average number of microfine fibers (B) present in the formed fiber was about 100, and the fibers (A) and (B) were approximately uniformly dispersed.

The resultant fibers were stretched by 3.0X, crimped, cut to a length of 51 mm, opened with a card, and formed into webs with a cross-lap webber. The webs were then made into a fiber-entangled non-woven fabric having a density of 600 g/m$^2$ by needle punching. The non-woven fabric was impregnated with a solution composed of 4 parts of a polyurethane composition whose chief component was a polyether-derived polyurethane and 96 parts of DMF, coagulated and washed with water. Thus a 1.3 mm-thick fibrous substrate was obtained. The polyurethane in the microfine fiber-forming fibers was at least partially dissolved in situ by the DMF during the above impregnation step, but was solidified again during the subsequent coagulation step.

When cross-sections of the fiber bundles in the fibrous substrate were observed with an electron microscope, average denier of fine fibers (A) was found to be 0.058, with substantially no denier variation; and that of the microfine fibers (B) was 0.003. In the interspaces among the microfine fibers in the fiber bundles, polyurethane was present in porous state.

This fibrous substrate was processed in the identical manner with Example 1 to be finished to a dyed, suede-like artificial leather.

The resulting product exhibited good developing property, but had a hard hand because the microfine fibers in the fiber bundles were mutually fixed with the polyurethane, i.e., because the polyurethane, an elastomeric polymer, was contained inside the fiber bundles. Also the appearance still left room for further improvement.

The test results of the suede-like artificial leathers which were obtained in above Examples and Comparable Examples are tabulated in Table 1 below.

TABLE 1

| | Within a Fiber Bundle | | | Raised Surface | | | | |
|---|---|---|---|---|---|---|---|---|
| | Fine fiber (A) (average dr.) | Microfine fiber (B) (average dr.) | Ratio of fiber numbers (A/B) | Ratio of fiber numbers[4] (A/B) | K/S[1] | Sensory Test[2] Appearance | Sensory Test[2] Feeling | Pilling[3] (grade) |
| Example 1 | 0.054 | 0.0045 | 1/1 | 8/1 | 15.6 | o | o | 4 |
| Comparative Example 1 | 0.063 | — | — | — | 16.5 | Δ | o | 3 |
| Comparative Example 2 | 0.034 | 0.004 | 1/3.6 | 2.2/1 | 10.5 | o | o | 4–5 |
| Example 2 | 0.060 | 0.005 | 1/1 | 8/1 | 14.5 | o | o | 4 |
| Comparative Example 3 | 0.058 | 0.003 | 1/2.0 | | 14.8 | Δ | x | 3–4 |

[1]Calculated by inserting the surface reflectivity R into the following equation: K/S = (1–R)2/2R
[2]Evaluated by randomly selected 20 panelers following the standards below: o : good Δ : less satisfactory x : poor
[3]Condition of each product after being treated with a pilling tester for 20 hours was observed.
[4]A 500X magnified electron micrograph was taken of each sample and visible numbers of raised fibers within an optionally selected 100 pm × 100 pm area in each micrograph were counted and the average values were calculated.

1) Calculated by inserting the surface reflectivity R into the following equation:

$$K/S=(1-R)2/2R$$

2) Evaluated by randomly selected 20 panelers following the standards below:

o: good

Δ: less satisfactory x: poor

3) Condition of each product after being treated with a pilling tester for 20 hours was observed.

4) A 500X magnified electron micrograph was taken of each sample and visible numbers of raised fibers within an optionally selected 100 μm×100 μm area in each micrograph were counted and the average values were calculated.

We claim:

1. A suede-like artificial leather whose substrate is composed of fiber bundles and an elastomeric polymer, said substrate having a nap on its surface composed of said fiber bundles, and being dyed, which leather is characterized in that said fiber bundles constituting the substrate are composed of fine fibers (A) having a fineness of 0.02–0.2 denier and microfine fibers (B) having a fineness not more than ⅕ of the average fineness of the fine fibers (A) and less than 0.02 denier, the ratio between the number of fine fibers (A) and that of the microfine fibers (B) ranging from 2/1 to 2/3, said fiber bundles not containing the elastomeric polymer in the interspaces among the individual fibers constituting each of the fiber bundles, and the ratio between the number of fine fibers (A) and that of the microfine fibers (B) in the fiber bundles constituting said nap being at least 3/1.

2. A suede-like artificial leather as described in claim 1, in which the fineness of the microfine fibers (B) is between 1/10 to 1/500f that of the average fineness of the fine fibers (A) and ranges from 0.01 to 0.001 denier.

3. A suede-like artificial leather as described in claim 1, in which the fineness of the microfine fibers (B) is between 1/10 to 1/50 of that of the average fineness of the fine fibers (A) and ranges from 0.01–0.0015 denier.

4. A suede-like artificial leather as described in claim 1, in which the fine fibers (A) and microfine fibers (B) are composed of melt-spinnable polyamides or melt-spinnable polyesters.

5. A suede-like artificial leather as described in claim 1, in which the elastomeric polymer is a polyurethane.

* * * * *